US008648769B2

(12) United States Patent
Pacetti et al.

(10) Patent No.: US 8,648,769 B2
(45) Date of Patent: Feb. 11, 2014

(54) ANTENNA BASE

(75) Inventors: Stefano Pacetti, Rome (IT); Lorenzo Piferi, Rome (IT); Gianluca Costanesi, Rome (IT)

(73) Assignee: Selex Sistemi Integrati S.p.A., Rome (IT)

( * ) Notice: Subject to any disclaimer, the term of this patent is extended or adjusted under 35 U.S.C. 154(b) by 230 days.

(21) Appl. No.: 13/315,416

(22) Filed: Dec. 9, 2011

(65) Prior Publication Data

US 2012/0146878 A1 Jun. 14, 2012

(30) Foreign Application Priority Data

Dec. 9, 2010 (IT) ..... TO2010A0979

(51) Int. Cl.
*H01Q 3/02* (2006.01)
*H01Q 1/08* (2006.01)

(52) U.S. Cl.
USPC ..... 343/882; 343/880

(58) Field of Classification Search
USPC ..... 343/878, 880, 882
See application file for complete search history.

(56) References Cited

U.S. PATENT DOCUMENTS

| | | | | |
|---|---|---|---|---|
| 2,901,208 | A | 8/1959 | Jones | |
| 3,341,151 | A * | 9/1967 | Kampinsky | 244/158.1 |
| 3,486,053 | A | 12/1969 | Richards | |
| 5,214,361 | A | 5/1993 | Labruyere | |
| 8,159,411 | B2 * | 4/2012 | Welsh et al. | 343/882 |

FOREIGN PATENT DOCUMENTS

| | | | |
|---|---|---|---|
| GB | 1295928 | A | 11/1972 |
| GB | 2257301 | A | 1/1993 |

OTHER PUBLICATIONS

Search Report in Italian Application No. T020100979, dated Jul. 7, 2011.

* cited by examiner

*Primary Examiner* — Hoang V Nguyen
(74) *Attorney, Agent, or Firm* — Marshall, Gerstein & Borun LLP

(57) ABSTRACT

An antenna base provided of a hollow support body having a fixed lower portion and an upper portion aligned along a longitudinal axis, the upper portion being adapted to support an antenna and being rotationally mounted on the lower portion to rotate, in use, together with the antenna itself, about the longitudinal axis; the antenna base being further provided with an electric motor, which is adapted to rotate the upper portion and is provided for this purpose with a stator integral with the lower integral and of a rotor integral with the upper portion and coaxial with the longitudinal axis.

13 Claims, 3 Drawing Sheets

ANTENNA BASE

CROSS-REFERENCE TO RELATED APPLICATIONS

This application claims the benefit of Italian Patent Application No. TO2010A 000979, filed Dec. 9, 2010.

The present invention relates to an antenna base.

In particular, the present invention relates to an antenna base of the type comprising a hollow support body having a longitudinal axis and comprising, in turn, two portions aligned along said longitudinal axis, and constituted by a lower fixed portion and an upper portion, which is adapted to support an antenna and is rotatably mounted on the lower portion to rotate, in use, together with the antenna, about the longitudinal axis; the antenna base further comprising actuator means adapted to rotate the upper portion.

BACKGROUND OF THE INVENTION

Normally, the actuator device comprises an electric gearmotor, which is generally mounted outside the support body on a peripheral zone of the lower portion with an output shaft thereof parallel to the longitudinal axis, and a transmission device, which is arranged inside the support body and normally consists of a mechanical geared transmission comprising a pinion keyed on the output shaft of the gearmotor and a toothed crown meshing with the pinion and rigidly connected to the upper portion.

The known antenna base described above has some drawbacks related, on one hand, to the presence of the gearmotor, which, being mounted outside the support body and in offset position with respect to the longitudinal axis, determines a considerable asymmetry in the total volume of the antenna base, with consequent problems of clearance and balancing of weights, and, on the other hand, to the presence of the geared transmission, which, in addition to having a large size and heavy weight, is subject to considerable wear, above all in critical working environments with the presence of dust, salt mist etc., and therefore requires frequent preventive and corrective maintenance interventions.

Furthermore, in order to guarantee the correct operation of the mechanical transmission, the support body must necessarily be provided with a gear lubrication system, normally an oil bath lubrication system, which considerably complicates the support body structure and implies the use of large amounts of "polluting" materials, such as lubricating oils.

Finally, a further drawback is constituted by the running noise, mainly deriving from the mechanical transmission.

The drawbacks described above are particularly critical when the known antenna described above is used in mobile land or maritime systems, in which light weight, compactness and limited need for maintenance interventions are particularly desirable requirements.

GB2257301, GB1295928, U.S. Pat. Nos. 3,486,053 and 2,901,208 suggest the use of an induction motor comprising a fixed part, the stator, connected to the fixed portion of the support body of the antenna and a mobile part, the rotor, connected to the antenna. These systems, however, suffer from the drawback of presenting relatively complex structures and are difficult to assemble, disassemble and maintain.

SUMMARY OF THE INVENTION

It is the object of the present invention to provide an antenna base which is free from the drawbacks described above.

In accordance with the present invention an antenna base is made as disclosed in the appended claims.

BRIEF DESCRIPTION OF THE DRAWINGS

The present invention will now be described with reference to the accompanying drawings, which illustrate some non-limitative embodiments thereof, in which.

DETAILED DESCRIPTION OF THE INVENTION

Figure 1:
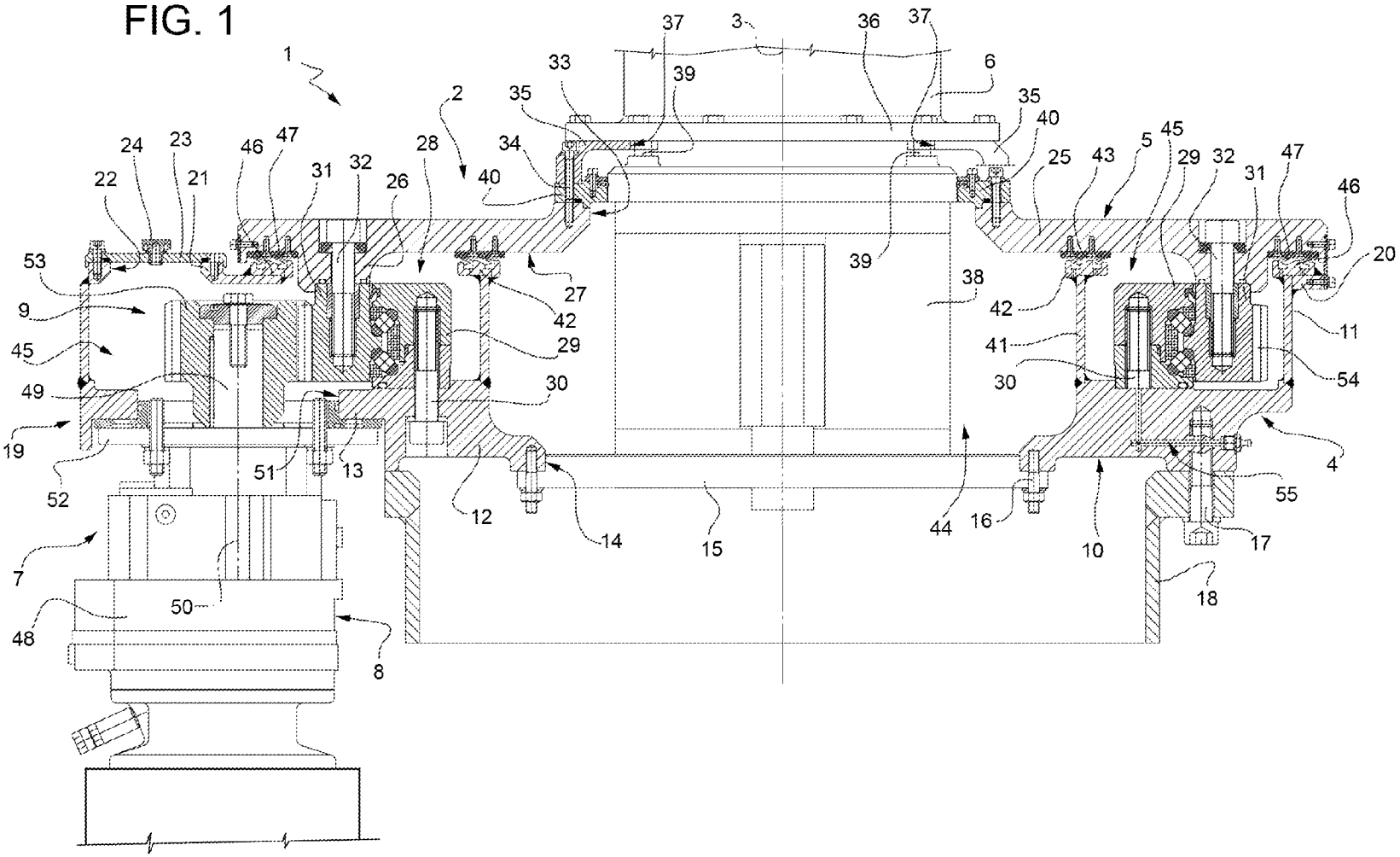
FIG. 1 shows, in axial section, an antenna base made according to the prior art.

In FIG. 1, numeral 1 indicates as a whole an antenna base according to the prior art.

The antenna base 1 comprises a hollow support body 2 having a longitudinal axis 3 and comprising two portions aligned with each other along axis 3 itself.

In particular, the two portions consist of a fixed lower portion 4, normally arranged at a given level from the ground with the interposition of a support base (not shown), and an upper portion 5, which is adapted to support an antenna 6 (of which only an attachment portion to the support body 2 is shown) and is rotationally mounted on the lower portion 4 to rotate, in use, together with the antenna 6, about axis 3.

For this purpose, the antenna base 1 comprises an actuator device 7, which will be described in detail below, comprising an electric gearmotor 8 arranged outside the support body 2 and a mechanical transmission 9 accommodated inside the support body 2 and interposed between the gearmotor 8 and the upper portion 5 to impart a rotary movement about axis 3 to the latter.

As shown in FIG. 1, the lower portion 4 is defined by a cup-shaped body arranged with the concavity thereof facing upwards and towards the upper portion 5 and comprises a bottom wall 10 extending on a plane transversal to axis 3 and a side wall 11 welded along a peripheral edge of the bottom wall 10.

In particular, the bottom wall 10 comprises a circular part coaxial to axis 3 and an eccentric part 13 radially protruding (leftwards in FIG. 1) from a peripheral edge of the circular part 11.

The circular part 12 centrally has a circular opening 14 coaxial to the axis 3 and closed by a lid 15 removably fixed, by means of screws 16, onto an outer edge of the opening 14. All around the opening 14, the bottom wall 10 carries, connected by means of screws 17 (of which only one is shown), an outer tubular appendix 18 coaxial to axis 3 and adapted to make the connection between the lower portion 4 and the mentioned supporting base (not shown).

Since the side wall 11 follows the outline of the bottom wall 10 to which it is rigidly connected, the side wall 11 also has a circular part coaxial to axis 3 and connected to the circular part 12 of the bottom wall 10, and an eccentric part connected to the eccentric part 13 of the bottom wall 10 and defining, with the eccentric part 13 itself, an eccentric appendix 19 of the lower portion 4.

At its upper free edge, the side wall 11 carries connected a circular flange 20, which, at the circular part of the side wall 11, extends outside the side wall 11 itself and is coaxial to axis 3, and, at the eccentric part of the side wall 11, extends within the side wall 11 and has a flared radial portion 21 joining the flange 20 to the free upper edge of the eccentric part of the side wall 11. A hole 22 closed by a lid 23 is obtained through the flared radial portion 21, through which an inlet fitting 24 for the lubrication oil is mounted.

The upper portion 5 comprises a circular platform 25, which lays on a plane transversal to longitudinal axis 3, has an outer diameter approximately equal to an outer diameter of the flange 20 and has, on the part facing the lower portion, an annular rib 26, which axially protrudes from a lower flat surface 27 of the platform 24, is coaxial to axis 3 and is radially arranged in the flange 20.

The platform 25 is rotationally mounted on the lower portion 4 with the interposition of a bearing 28, in particular an oblique bearing with two ball crowns, which is provided with an inner ring 29 rigidly blocked onto the bottom wall 10 by means of screws 30, and an outer ring 31 rigidly blocked onto the annular rib 26 by means of screws 32.

In position facing the opening 14, the platform 25 has a circular opening 33, which is coaxial to axis 3, has a diameter slightly smaller than the diameter of the opening 14, and is surrounded, on the part facing the outside of the support body 2, by a raised edge, onto which an attachment flange 35 of the antenna 6 to the platform 25 is fixed by means of screws 34.

In particular, the flange 35 has in transversal section an L-shape and comprises a cylindrical portion coaxial to axis 3 and a circular portion, which extends radially towards axis 3, rigidly carries connected a lower attachment plate 36 of the antenna 6, and has, along its inner free edge, a plurality of slots 37, uniformly distributed about axis 3 and open towards axis 3 itself.

Under the plate 36, in the space comprised between the plate 36 and the lid 23, the support body 2 accommodates a joint 38 carrying the connections (not shown) for supplying electricity and cooling fluids to the antenna 6. The joint 38 is defined by a cylindrical body coaxial to axis 3, supported by the lid 23 and having, on the upper end thereof, facing the plate 36, a plurality of pins 39, which are uniformly distributed along axis 3 and are each inserted in a respective slot 37 so as to angularly secure the joint 38 to the flange 35 and, consequently, to the platform 25. In order to maintain the joint 38 in its correct axial position with respect to axis 3, the upper portion 5 comprises a centering ring 40, which is secured, by means of screws 34, between the flange 35 and the raised edge delimiting the opening 33, radially protrudes within the opening 33 itself and is delimited towards the joint 38, by a cylindrical surface coaxial to axis 3 and slidingly coupled, with interposition of an anti-friction material seal, to a flared cylindrical portion of the joint 38.

As shown in FIG. 1, the space inside the support body 2 delimited by the lower portion 4 and the upper portion 5 is internally divided by a tubular socket 41, which is coaxial to axis 3, is welded to the bottom wall 10 in intermediate position between the opening 14 and the inner ring 29, and is coupled to the surface 27 of the platform 25 by means of a sliding ring 42 cooperating with an annular anti-friction pad 43 integral with the surface 27. The socket 41 delimits, in the support body 2, two chambers, of which a central chamber 44, which accommodates the joint 38, and an annular chamber 45, which accommodates the bearing 28, extends through the eccentric appendix 19 and is fluid-tightly closed towards the inside, i.e. towards the central chamber 44, by means of the sealing ring 42 and towards the outside by means of a further sliding sealing ring 46 rigidly connected to the flange 20 and cooperating with an annular anti-friction block 47 integral with an annular portion of the surface 27 facing the flange 20.

With regards to the previously mentioned actuator device 7, the gearmotor 8 is mounted at the eccentric appendix 19 on the outside, and underneath, on the eccentric side 13 of the bottom wall 10 and comprises a casing 48 and an output shaft 49, which is rotational about an axis 50 parallel to axis 3 and extends inside the annular chamber 45 through a hole 51 obtained through the eccentric portion 13. The gearmotor 8 is fixed to the eccentric portion 13 by means of a flange 52 coaxial to the axis 50, integral with the casing 48 and connected by means of screws to the eccentric portion 13 with the interposition of a sealing ring.

The mechanical transmission 9 is a geared transmission and comprises a pinion-crown coupling, the pinion 53 of which is keyed, and axially blocked, to the shaft 49, and the crown 54 is defined by a toothing obtained on the cylindrical side surface of the outer ring 31 of the bearing 28.

In use, when the gearmotor 8 is actuated, the shaft 49 rotationally carries the pinion 53 about the axis 50, which pinion, by meshing with the crown 54, allows the rotation of the crown 54 itself, and consequently of the upper portion 5 and of the antenna 6, about the axis 3.

The lubrication of the mechanical transmission 9 is obtained by means of an oil bath system, which oil, in use, is made to flow into the annular chamber 45 by means of the inlet fitting 24. The rolling elements of the bearing 28 are, instead, lubricated, when needed, by means of a lubrication circuit 55 obtained in the bottom wall 10.

Figure 2:
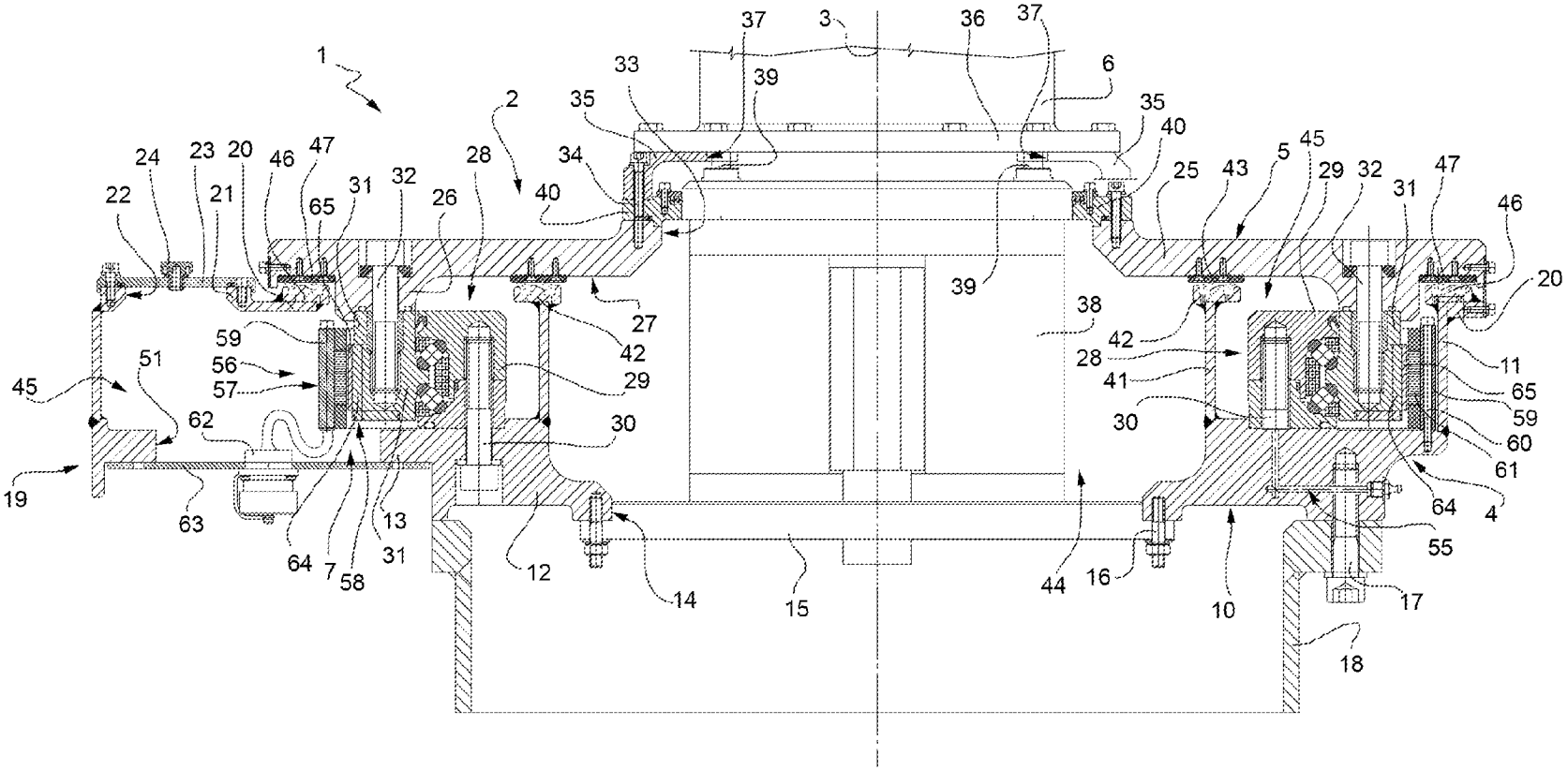
FIG. 2 shows, in axial section, a preferred embodiment of the antenna base according to the present invention.
Figure 3:
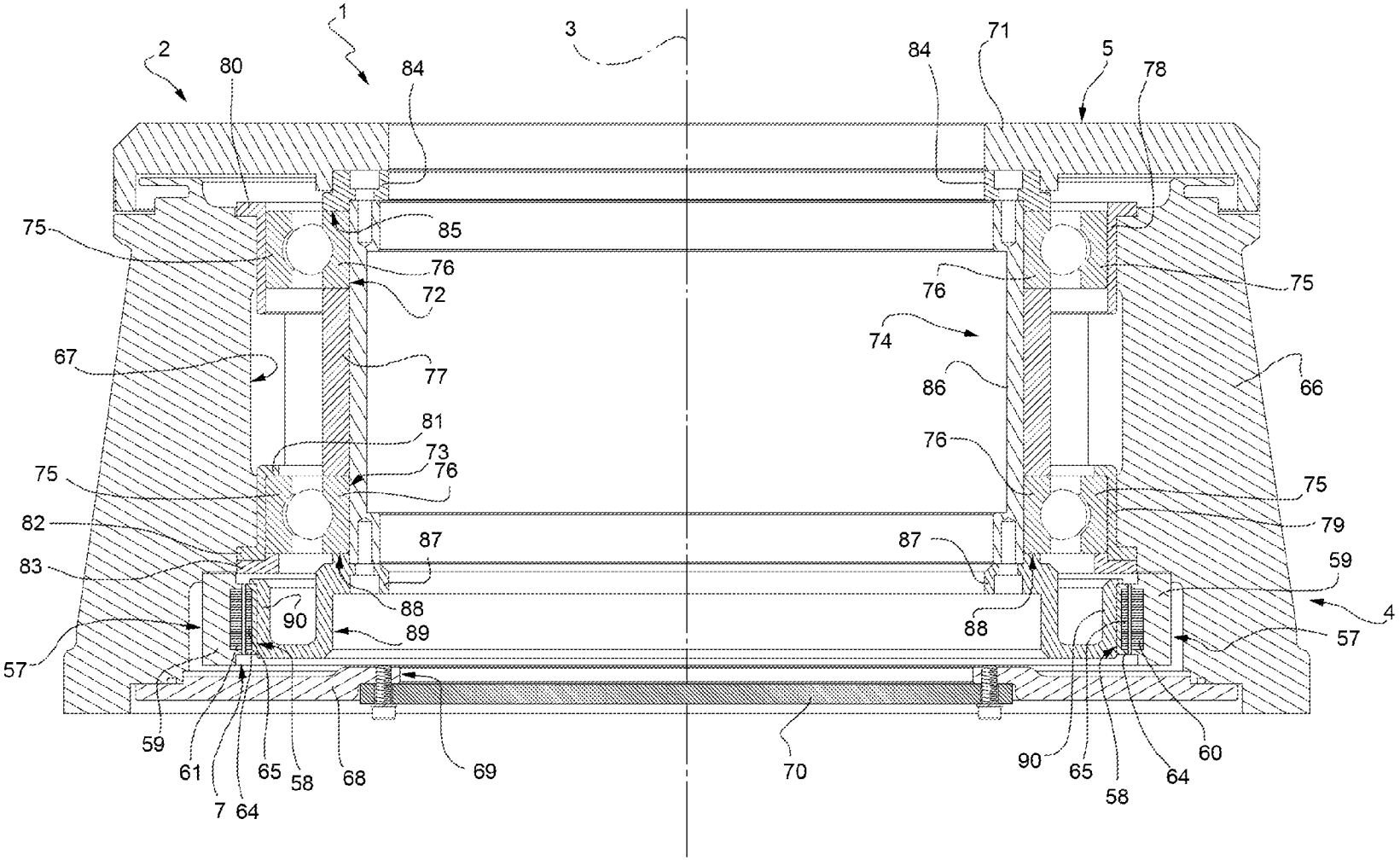
FIG. 3 shows, in axial section, a further embodiment of the antenna base according to the present invention.

FIGS. 2 and 3 show two embodiments of an antenna base made according to the present invention. For the sake of simplicity, in the following description of these two embodiments, parts which are structurally or functionally similar to corresponding parts of the known antenna base 1 in FIG. 1 are identified, were possible, with the same reference numerals used in the description in FIG. 1.

FIG. 2 shows an antenna base 1 obtained by appropriately modifying a known antenna base of the type described with reference to FIG. 1. In particular, the difference between the antenna base 1 in FIG. 2 and antenna base 1 of known type in FIG. 1 essentially resides in the actuator device 7, while the support body 2 remains virtually identical.

In essence, the actuator device 7 of the antenna base in FIG. 2 is free from the mechanical transmission 9 and the outer gearmotor 8 is replaced by an electric motor 56, preferably a direct synchronous motor, arranged within the annular chamber 45 and comprising a stator 57, integral with the lower portion 4 and a rotor 58 integral with the upper portion 5.

More in detail, the stator 57 is a lamellar stator and comprises a stator crown 59, which is coaxial to axis 3, is rigidly connected, by means of screws 60, to the bottom wall 10 in position facing the side wall 11, and has towards the rotor 58, a plurality of longitudinal cavities accommodating respective excitation conductive elements 61 connected to one another and connected to an electric terminal 62 carried by a plate 63 placed for closing the hole 51.

In turn, the rotor 58 comprises a rotor crown 64, which is coaxial to axis 3 and to the stator crown 59 and is rigidly connected to the outer cylindrical surface of the outer ring 31, which naturally is free from the toothing constituting the crown 54. The rotor crown 64 has a plurality of longitudinal cavities accommodating respective induced conductive elements 65 constituted by permanent magnets towards the stator 57.

In use, when electricity is supplied to the excitation conductive elements 61, the rotating magnetic field generated by the stator 57 feeds the magnetic field of the rotor 58 generating a motive torque which makes the rotor 58 turn about axis 3, and the outer ring 31, the upper portion 5 and the antenna 6 together with the rotor.

Turning now to the antenna base 1 in FIG. 3, the description above related to actuator device 7 of the antenna base 1 in FIG. 2 remains entirely valid from the structural and functional point of view also for the antenna base 1 in FIG. 3.

With regards to the structure of the support body 2, instead, the antenna base 1 shown in FIG. 3 considerably differs from that shown in FIG. 2.

In particular, the lower portion 4 is defined, in this case, by a frustum-shaped tubular body 66 having an inner cylindrical cavity 67 coaxial to the axis 3 and closed at the bottom by a plate 68, which is removably connected by means of screws (not shown) to the tubular body 66 and centrally has an opening 69 closed by a removable lid 70.

The upper portion 5 comprises an annular platform 71, which corresponds to the platform 25 of the example in FIG. 2 and is adapted to be rigidly connected (in manner not shown) to an attachment portion of an antenna (not shown).

The platform 71 is rotationally mounted on the lower portion 4 about the axis 3 with interposition of a pair of radial bearings 72 and 73, preferably ball bearings, and a rotating support 74, which is in the part of the upper portion 5 integral with the platform 71.

More in detail, the bearings 72 and 73 each have an outer ring 75 and an inner ring 76 coaxial to the axis 3, are coupled axially by means of a tubular spacer 77 interposed between the respective inner rings 76, and are driven into the cavity 67 by means of respective bushings 78, 79 arranged respectively at the platform 71 and of the plate 68. The bushing 78 has, on an upper edge, an outer radial flange 80, which is abuttingly arranged against an annular shoulder of the tubular body 66 facing the platform 71 to axially block the bushing 78 with respect to the tubular body 66 itself; the bushing 79 has an inner radial flange 81 abuttingly arranged against an upper end of the respective outer ring 75 at an upper end thereof, and an outer radial flange 82 arranged abuttingly against an annular shoulder of the tubular body 66 facing the plate 68 at a lower end thereof.

The axial downward removal of the bearings 72 and 73 is prevented by a retaining ring 83 arranged immediately underneath, and in contact with the bearing 73 and with the respective bushing 79 and is rigidly connected (in manner not shown) to the tubular body 66.

The platform 71 is made integral with the inner rings 76 of the bearings 72, 73 by means of the mentioned rotating support 74, which consists of three parts: an upper annular body 84, which is fixed (in manner not shown) to a lower surface of the platform 71 and has, on the side opposite to the one coupled to the platform 71, an annular shoulder 85 arranged resting on a corresponding axial end surface of the inner ring 76 of the bearing 72; a socket 86, which is fixed by means of screws to the upper annular body 84 and extends, in position coaxial to axis 3 and tangent to the inner rings 76, up to and a little beyond the lower inner ring 87, which is fixed by means of screws to the socket 86 and has an annular shoulder 88 facing the shoulder 85 of the upper annular body 84 and secured against a corresponding axial end surface of the inner ring 76 of the bearing 73.

From the above it derives that the rotating support 74 has the function of sandwiching the bearings 72 and 73 and the spacer 77 against one another so that the platform 71 is integral with the inner rings 76 of the bearings 72 and 73 themselves and is free rotate about the axis 3.

Furthermore, the lower annular body 87 carries connected a tubular appendix 89 with U-shaped transversal section U, which is accommodated in a flared portion of the cavity 67 between the retaining ring 83 and the plate 68 and has an outer wall 90 coaxial to the axis 3 and, connected the rotor, rigidly carrying the crown 64. The stator crown 59 is rigidly fixed instead (in manner not shown) to the tubular body 66 so that the excitation conductive elements 57 are facing, with the interposition of a given gap of constant width, to the induced conductive elements 65 of the rotor 58.

With this regard, it is worth specifying that in the example shown above the presence of a pair of bearings is justified by stability needs given the longitudinal dimension of the tubular body 66 with respect to the transversal dimension. Obviously, if the tubular body 66 has a smaller longitudinal dimension, only one bearing would suffice and the spacer 77 would be eliminated as a consequence.

In use, as the rotor 58 is integral with the rotating support 74, and the latter is integral with the platform 71, the actuation of the motor 56 determines the rotation of the platform 71 and of the antenna 6 about axis 3.

By comparing the known antenna base 1 in FIG. 1 and the antenna bases 1 constituting the two embodiments of the present invention shown in FIGS. 2 and 3, it results that the mentioned embodiments in FIGS. 2 and 3 allow, by virtue of the elimination of the gearmotor 8 and the mechanical transmission 9, to considerably reduce the weight and total dimensions, to eliminate asymmetric volumes and to use a smaller number of components with the advantage of less design complexity and greater system reliability.

Furthermore, in the embodiments in FIGS. 2 and 3, the advantages of the elimination of the mechanical transmission 9 of the known antenna base 1 in FIG. 1 are:

a) a large amount of lubricant oil is no longer needed as indispensable, instead, in known antenna base 1 in FIG. 1 for oil bath lubrication of the gears;

b) quieter operation is obtained;

c) heavy wear components are no longer used, such as gears and, consequently, frequent preventive and corrective maintenance interventions are no longer needed.

A further advantage of the embodiments in FIGS. 2 and 3 with respect to the known antenna base 1 in FIG. 1 consists in that the actuator device 7 may be servo-controlled obtaining better dynamic performance both in terms of driving accuracy and in terms of programmed speed stability.

Finally, specifically with regards to the antenna base 1 illustrated in FIG. 3, it is worth specifying that this embodiment allows to obtain that this further embodiment allows to obtain a further considerable advantage in that it allows an operator to access the motor 56 and the bearings 72 and 73 for maintenance reasons without needing to preventively disassemble the antenna 6. Indeed, it is possible to access inside the tubular body 66 from the bottom simply by removing the plate 68; at this point, the stator 57 may be freely disassembled from the tubular body 66, the rotor 58 may be detached simply by removing the screws which connect the lower annular body 87 to the socket 86; the bearing 72 is freely removable after disassembly from the lower annular body 87 and the retaining ring 83, and finally the bearing 73 may be removed after having removed the socket 86.

Again with regards to the embodiment in FIG. 3, it is worth noting that the support body 2, by virtue of its simplified and compact structure, is advantageously suitable to be made by means of light alloy casting, e.g. aluminum, or composite materials, e.g. carbon, allowing to obtain an even greater reduction of total weight.

The invention claimed is:

1. An antenna base comprising a support body (2) having a longitudinal axis (3)and, in turn, comprising a fixed lower portion (4) and an upper portion (5) aligned to one another along the longitudinal axis (3), the upper portion (5) being designed to support an antenna (6) and being mounted on the lower portion (4) to rotate, during operation, together with the antenna (6), about the longitudinal axis (3); the antenna base (1) further comprising actuator means (7), which are configured to rotate the upper portion (5) and comprise an electric motor (56) having a stator (57) rigidly connected to the lower portion (4), and a rotor (58) rigidly connected to the upper portion (5) and coaxial to the longitudinal axis (3); the antenna base (1) being characterized in that the lower portion (4) comprises a tubular body (66) having an inner cylindrical cavity (67), which is coaxial to the longitudinal axis (3) and has an opening at its lower axial end; the upper portion (5) being mounted on the lower portion (4) with the interposition of at least a radial bearing (72; 73), which is mounted within said cavity (67), is coaxial to the longitudinal axis (3) and comprises an inner ring (76) rigidly connected to the upper portion (5), and an outer ring (75) rigidly connected to the lower portion (4).

2. The antenna base claimed in claim 1, wherein the stator (57) and the rotor (58) are arranged within the cavity (67).

3. The antenna base claimed in claim 2, wherein the upper portion (5) comprises a rotary support element (74), which is rigid with the inner ring (76) and comprises a first axial end portion (84) rigidly connected to the upper portion (5), and a second axial end portion (87) arranged between the bearing (72; 73) and said opening and connected to the rotor (58).

4. The antenna base claimed in claim 3, wherein said second axial end portion (87) comprises a cylindrical wall (90) coaxial to the longitudinal axis (3); the rotor (58) comprising a rotor crown (64) coaxial to the longitudinal axis (3) and rigidly connected to the cylindrical wall (90); and the stator (57) comprises a stator crown (59) coaxial to the longitudinal axis (3) and rigidly connected to the tubular body (66) in a position facing the rotor crown (64).

5. The antenna base claimed in claim 4, wherein the stator crown (59) comprises, facing the rotor (58), a plurality of longitudinal seats accommodating respective excitation conductive elements (61) connected to one another and to an electric power supply terminal (62); and the rotor crown (64) comprises, facing the stator (57), a plurality of longitudinal seats accommodating respective induced conductive elements (65), preferably permanent magnets.

6. The antenna base claimed in claim 2, wherein the stator (57), the rotor (58) and the bearing (72; 73) are extractable form the cavity (67) through said opening.

7. The antenna base claimed claim 2, wherein the support body (2) is made of an aluminum alloy or a composite material, for example carbon.

8. An antenna assembly comprising an antenna base as claimed in claim 1.

9. An antenna base comprising a support body (2) having a longitudinal axis (3) and, in turn, comprising a fixed lower portion (4) and an upper portion (5) aligned to one another along the longitudinal axis (3), the upper portion (5) being adapted to support an antenna (6) and being mounted on the lower portion (4) to rotate, in use, together with the antenna (6), about the longitudinal axis (3); the antenna base (1) further comprising actuator means (7), which are configured to rotate the upper portion (5) and comprise an electric motor (56) having a stator (57) rigidly connected to the lower portion (4), and a rotor (58) rigidly connected to the upper portion (5) and coaxial to the longitudinal axis (3); the antenna base (1) being characterized in that the upper portion (5) is mounted on the lower portion (4) with the interposition of a bearing (28), which is coaxial to the longitudinal axis (3) and comprises a first ring (29) rigidly connected to the lower portion (4), and a second ring (31) rigidly connected to the upper portion (5); the rotor (58) comprising a rotor crown (64) coaxial to the longitudinal axis (3) and rigidly connected to the second ring (31).

10. The antenna base claimed in claim 9, wherein the stator (57) and the rotor (58) and arranged within the support body (2).

11. The antenna base claimed in claim 9, wherein the first ring (29) is arranged inside the second ring (31); the rotor crown (64) being rigidly connected to an outer cylindrical surface of the second ring (31).

12. The antenna base claimed in claim 11, wherein the stator (57) comprises a stator crown (59) coaxial to the longitudinal axis (3); the lower portion (4) comprising a lateral wall (11) surrounding the second ring (31), and the stator crown (59) being rigidly connected to the lateral wall (11) in a position facing the second ring (31) and the rotor crown (64).

13. The antenna base claimed in claim 12, wherein the stator crown (59) comprises, facing the rotor (58), a plurality of longitudinal seats accommodating respective excitation conductive elements (61) connected to one another and to an electric power supply terminal (62); and the rotor crown (64) comprises, facing the stator (57), a plurality of longitudinal seats accommodating respective induced conductive elements (65), preferably permanent magnets.

* * * * *